US007828559B2

(12) United States Patent
Chen et al.

(10) Patent No.: US 7,828,559 B2
(45) Date of Patent: Nov. 9, 2010

(54) BOARD-TO BOARD CONNECTOR ASSEMBLY

(75) Inventors: Chung-yu Chen, Tu-Cheng (TW); Yung-chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 96 days.

(21) Appl. No.: 12/314,531

(22) Filed: Dec. 12, 2008

(65) Prior Publication Data

US 2010/0151702 A1 Jun. 17, 2010

(51) Int. Cl.
*H01R 12/00* (2006.01)

(52) U.S. Cl. ..... 439/74

(58) Field of Classification Search ..... 439/74, 439/660

See application file for complete search history.

(56) References Cited

U.S. PATENT DOCUMENTS 5,876,217 A * 3/1999 Ito et al. ..... 439/74
6,645,005 B2 * 11/2003 Wu ..... 439/563
2008/0207014 A1 * 8/2008 Takeuchi et al. ..... 439/74

* cited by examiner

*Primary Examiner*—Edwin A. Leon
*Assistant Examiner*—Vanessa Girardi
(74) *Attorney, Agent, or Firm*—Rosenberg, Klein & Lee

(57) ABSTRACT

A board-to-board connector assembly includes a receptacle connector and a plug connector mated with each other. The receptacle connector has a receptacle housing, a plurality of first terminals disposed in the receptacle housing, and at least one first fixing member mounted to the receptacle housing and having a base portion. A top of the base portion is bent toward one side and then extends downward to form a propping portion defining a first fixing structure thereon. The plug connector has a plug housing, a plurality of second terminals disposed in the plug housing and contacting the corresponding first terminals electrically, and at least one second fixing member mounted to the plug housing and having a base board. At least one end of the base board extends downward to form a connecting portion defining a second fixing structure thereon which can be buckled with the first fixing structure.

9 Claims, 6 Drawing Sheets

BOARD-TO BOARD CONNECTOR ASSEMBLY

BACKGROUND OF THE INVENTION

1. Field of the Invention

The present invention generally relates to an electrical connector, and more particularly to a board-to-board connector assembly.

2. The Related Art

Referring to FIG. 10, a conventional board-to-board connector assembly 1' includes a receptacle connector 10' having a receptacle housing 11' and a plurality of first terminals 13' disposed in the receptacle housing 11' respectively, and a plug connector 20' having a plug housing 21' and a plurality of second terminals 23' disposed in the plug housing 21' respectively. The receptacle housing 11' defines a rectangular receiving recess 12' therein and the plug housing 21' defines a rectangular inserting wall 22' thereon. When the plug connector 20' is engaged with the receptacle connector 10', the inserting wall 22' is inserted into the receiving recess 12' and the second terminals 23' electrically contact the corresponding first terminals 13' so as to form an electrical connection therebetween. However, the plug connector 20' is engaged with the receptacle connector 10' only by means of the inserting wall 22' inserted in the receiving recess 12', as a result, the plug connector 20' is apt to fall off from the receptacle connector 10' if the board-to-board connector assembly 1' is shaken such that results in an unsteady connection between the first terminals 13' and the corresponding second terminals 23'. Therefore, a board-to-board connector assembly capable of overcoming the foregoing problem is required.

SUMMARY OF THE INVENTION

An object of the present invention is to provide a board-to-board connector assembly including a receptacle connector and a plug connector mated with the receptacle connector. The receptacle connector includes a receptacle housing defining a receiving recess at a top thereof and four sidewalls formed around the receiving recess, a plurality of first terminals disposed in the receptacle housing, and at least one first fixing member having a base portion disposed in the sidewall. A top of the base portion is bent toward one side and then extends downward to form a propping portion stretching into the receiving recess and defining a first fixing structure thereon. The plug connector includes a plug housing received in the receiving recess of the receptacle housing, a plurality of second terminals disposed in the plug housing and contacting the corresponding first terminals electrically, and at least one second fixing member having a base board disposed on the plug housing. At least one end of the base board extends downward to form a connecting portion disposed on an outside surface of the plug housing and defining a second fixing structure thereon. Wherein the second fixing structure is buckled with the first fixing structure and the connecting portion abuts against the propping portion such that can ensure that the receptacle connector and the plug connector are engaged with each other firmly. So a steady electrical connection between the first terminals and the second terminals can be achieved even if the board-to-board connector assembly is shaken.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
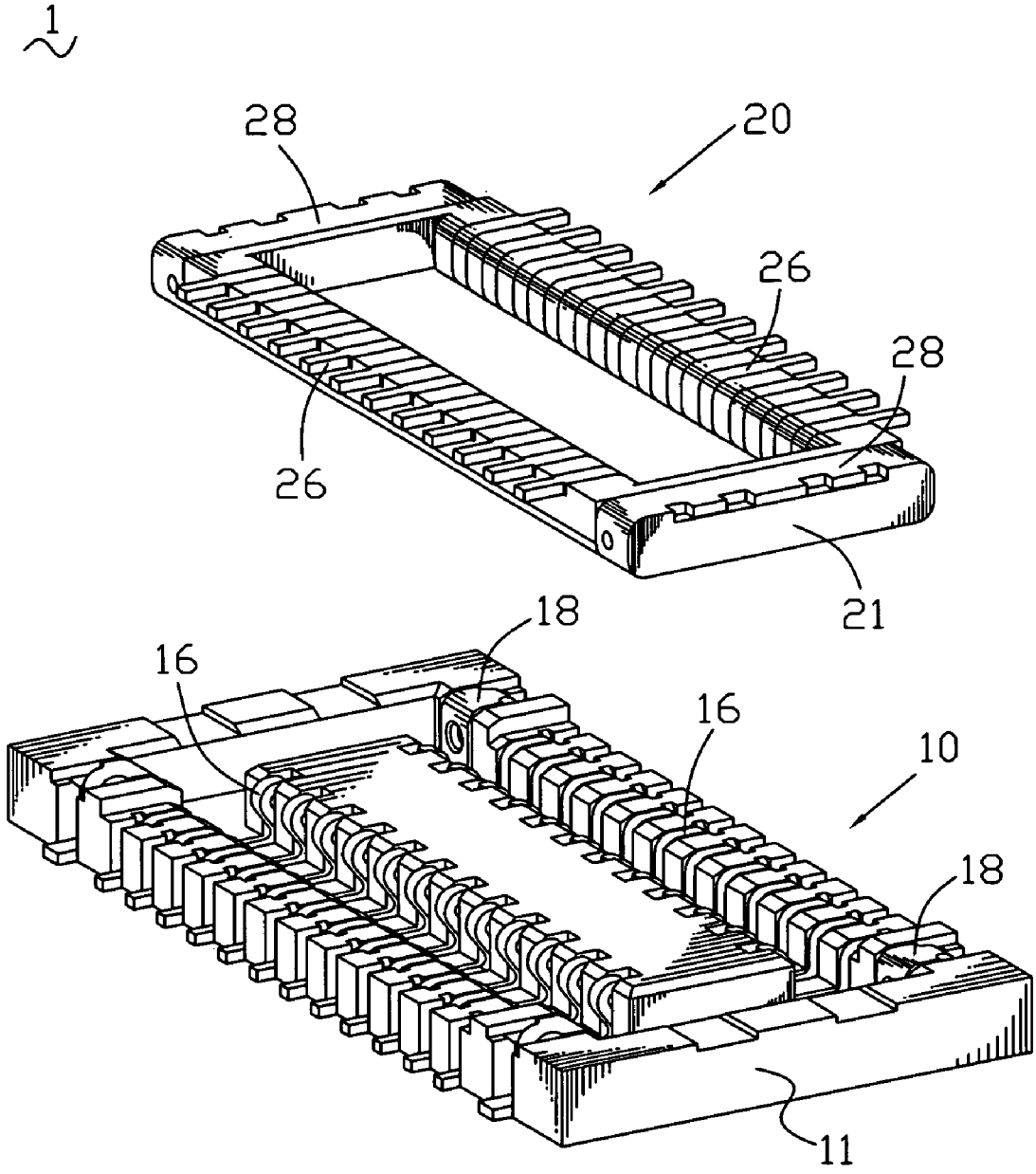
FIG. 1 is a perspective view of a board-to-board connector assembly in accordance with the present invention.

Referring to FIG. 1, a board-to-board connector assembly 1 in accordance with the present invention includes a receptacle connector 10 and a plug connector 20 mated with each other. The receptacle connector 10 includes a receptacle housing 11, a plurality of first terminals 16 and four first fixing members 18 disposed in the receptacle housing 11 respectively.

Figure 2:
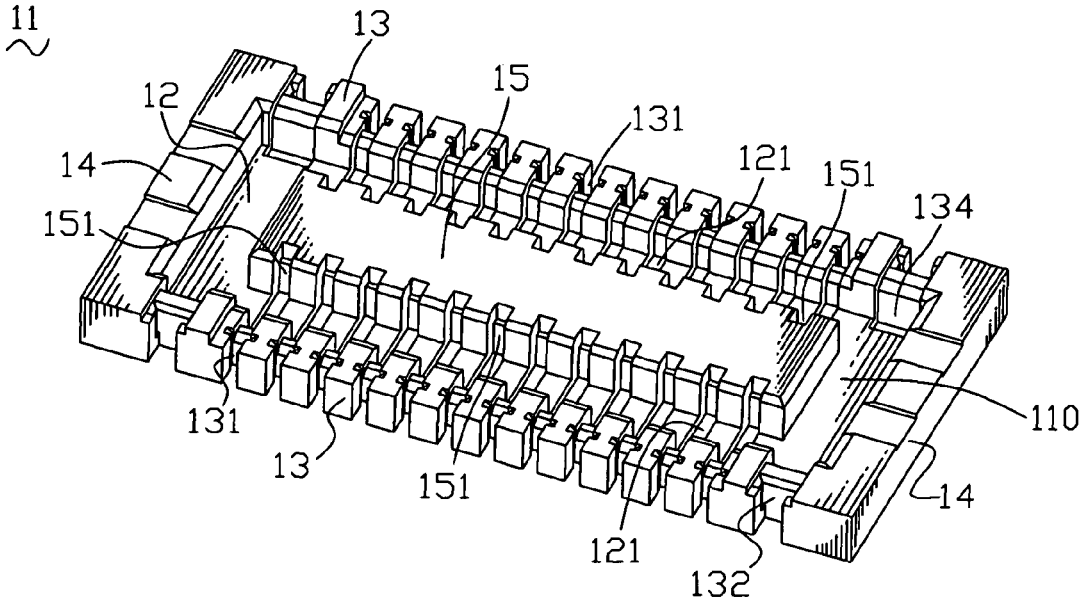
FIG. 2 is a perspective view of a receptacle housing of a receptacle connector of the board-to-board connector assembly of FIG. 1.
Figure 3:
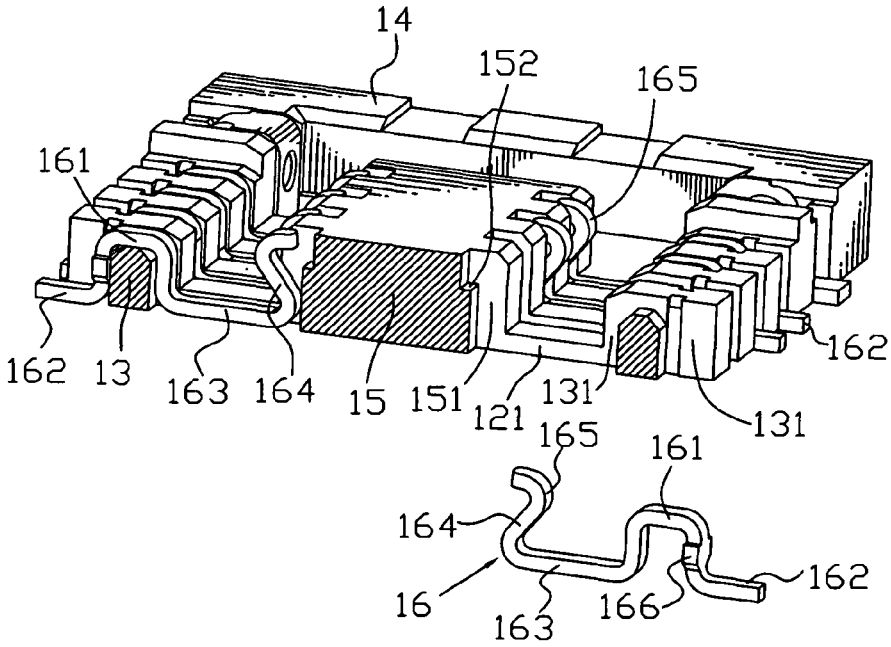
FIG. 3 is a sectional view of the receptacle connector of the board-to-board connector assembly of FIG. 1, with a first terminal being exposed therefrom.
Figure 4:
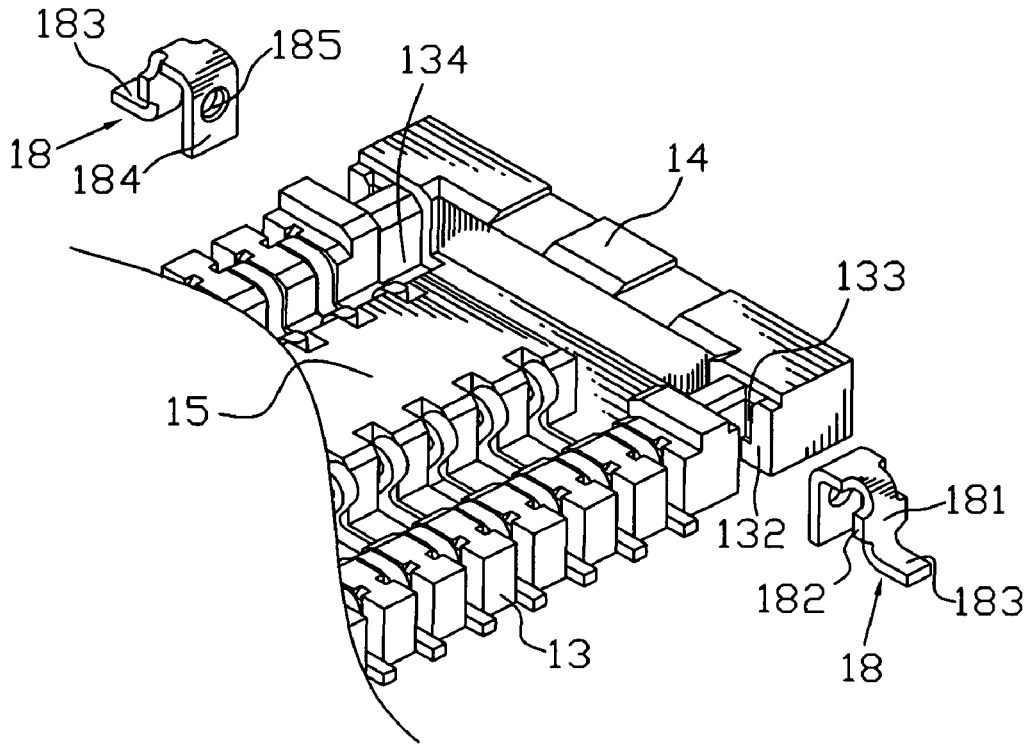
FIG. 4 is a partial view of the receptacle connector of the board-to-board connector assembly of FIG. 1.

Referring to FIGS. 2, 3 and 4, the receptacle housing 11 has a rectangular base board 12 disposed levelly. Two opposite sides of the base board 12 extend upward to form a pair of first sidewalls 13 extending longwise. Two opposite ends of the base board 12 extend upward to form a pair of second sidewalls 14. A middle of the base board 12 protrudes upward to form a rectangular inserting rib 15 extending longwise and having two ends apart from the corresponding second sidewalls 14. Accordingly, a ringlike receiving recess 110 is formed among the base board 12, the first sidewalls 13, the second sidewalls 14 and the inserting rib 15. Each of the first sidewalls 13 defines a plurality of inverted-U shaped receiving grooves 131 arranged at regular intervals along a longwise direction and each traversing the corresponding first sidewall 13 to communicate with the outside and the receiving recess 110. Two opposite sides of the inserting rib 15 respectively define a plurality of receiving channels 151 corresponding to the receiving grooves 131 one-on-one and communicating with the receiving recess 110. Each of the receiving channels 151 extends vertically to penetrate through the inserting rib 15 and a top thereof further extends inward so as to make a propping platform 152 formed therein. Two sides of the base board 12 define a plurality of receiving slots 121 communicating with the receiving recess 110 and each extending transversely to connect the receiving groove 131 and the corresponding receiving channel 151. Two ends of an outside of each of the first sidewalls 13 respectively define a receiving cavity 132 penetrating from top to bottom. A top of the receiving cavity 132 oppositely extends sideward to form a pair of fixing cavities 133. Two ends of an inside of each of the first sidewalls 13 respectively define a fastening channel 134 extending vertically to penetrate through the base board 12 and communicating with the receiving recess 110. A top end of the receiving cavity 132 is connected with a top end of the corresponding fastening channel 134.

Referring to FIG. 3 again, each of the first terminals 16 has an inverted-U shaped base body 161. Two bottom ends of the base body 161 oppositely extend to form a soldering arm 162 and a connecting arm 163 which are located in the same plane with the base body 161. A free end of the connecting arm 163 extends upward and inclines toward the base body 161 to form an elastic arm 164. A free end of the elastic arm 164 is bent oppositely the base body 161 to form a contact portion 165. Two side edges of the base body 161 oppositely protrude outward to form two fixing lumps 166 near the soldering arm 162.

Referring to FIG. 4 again, each of the first fixing members 18 has a base portion 181 disposed vertically. A bottom of the base portion 181 extends levelly toward one side to form a soldering portion 183. A top of the base portion 181 is bent toward the other side opposite to the soldering portion 183 and then extends downward to form a propping portion 184. The propping portion 184 defines a first fixing structure thereon. In this embodiment, the first fixing structure is a fixing hole 185 passing therethrough and facing the base portion 181. Two side edges of the base portion 181 protrude oppositely to form two fixing blocks 182.

When the receptacle connector 10 is assembled, the base body 161 of each of the first terminals 16 is inserted in the corresponding receiving groove 131 and the fixing lumps 166 are inserted in two opposite sides of the corresponding receiving groove 131. The connecting arm 163 is received in the corresponding receiving slot 121. The elastic arm 164 is received in the corresponding receiving channel 151 and the contact portion 165 stretches into the receiving recess 110. The soldering arm 162 partially stretches out of the corresponding receiving groove 131 for being soldered to a female printed circuit board (not shown). The first fixing members 18 are mounted to two ends of the corresponding first sidewalls 13. The base portion 181 is received in the corresponding receiving cavity 132, and the fixing blocks 182 are buckled into the corresponding fixing cavities 133. The propping portion 184 is inserted in the corresponding fastening channel 134 and the fixing hole 185 communicates with the receiving recess 110. So the first fixing members 18 can be firmly mounted to the corresponding first sidewalls 13. The soldering portion 183 of each of the first fixing members 18 partially stretches out of the corresponding receiving cavity 132 for being soldered to the female printed circuit board.

Referring to FIG. 1 again, the plug connector 20 includes a plug housing 21 mated with the receptacle housing 11, a plurality of second terminals 26 and two second fixing members 28 disposed in the plug housing 21 respectively.

Figure 5:
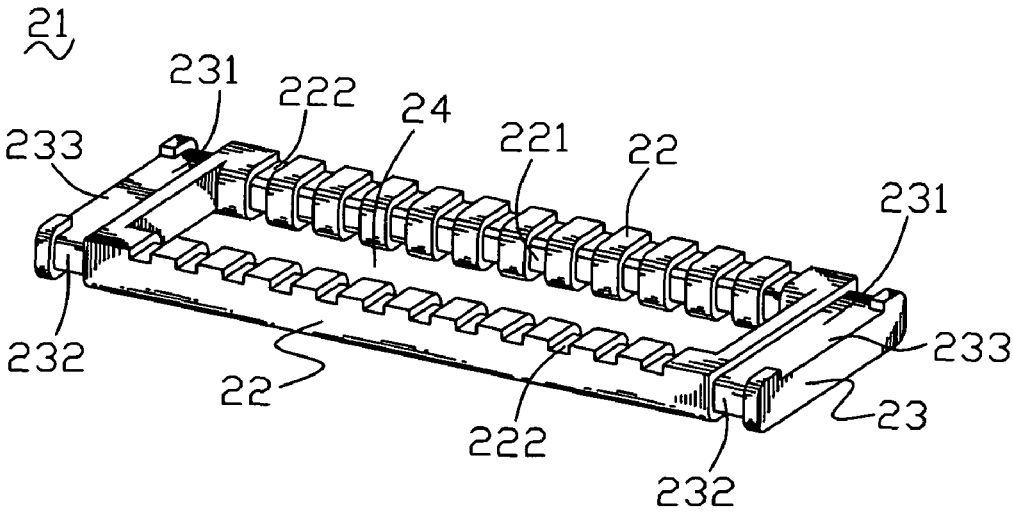
FIG. 5 is a perspective view of a plug housing of a plug connector of the board-to-board connector assembly of FIG. 1.

Referring to FIG. 5, the plug housing 21 is of a rectangular hollow shape and has a pair of third sidewalls 22 extending longwise and a pair of fourth sidewalls 23 each connected with corresponding two ends of the third sidewalls 22. Accordingly, a rectangular receiving space 24 is surrounded by the third sidewalls 22 and the fourth sidewalls 23. An inside of each of the third sidewalls 22 defines a plurality of receiving passageways 221 arranged at regular intervals along a longwise direction thereof and each extending vertically to pass therethrough. Each of the receiving passageways 221 communicates with the receiving space 24, and has a top end extended transversely to a top surface of the corresponding third sidewall 22 to form a receiving trough 222. Two opposite end surfaces of each of the fourth sidewalls 23 respectively define a fastening fillister 232 extending vertically to pass therethrough. A top surface of each of the fourth sidewalls 23 defines a receiving fillister 231 extending transversely to connect with two top ends of the corresponding fastening fillisters 232. A middle of each of the receiving fillisters 231 extends outward to pass through a side surface of the corresponding fourth sidewall 23 to form a fixing groove 233.

Figure 6:
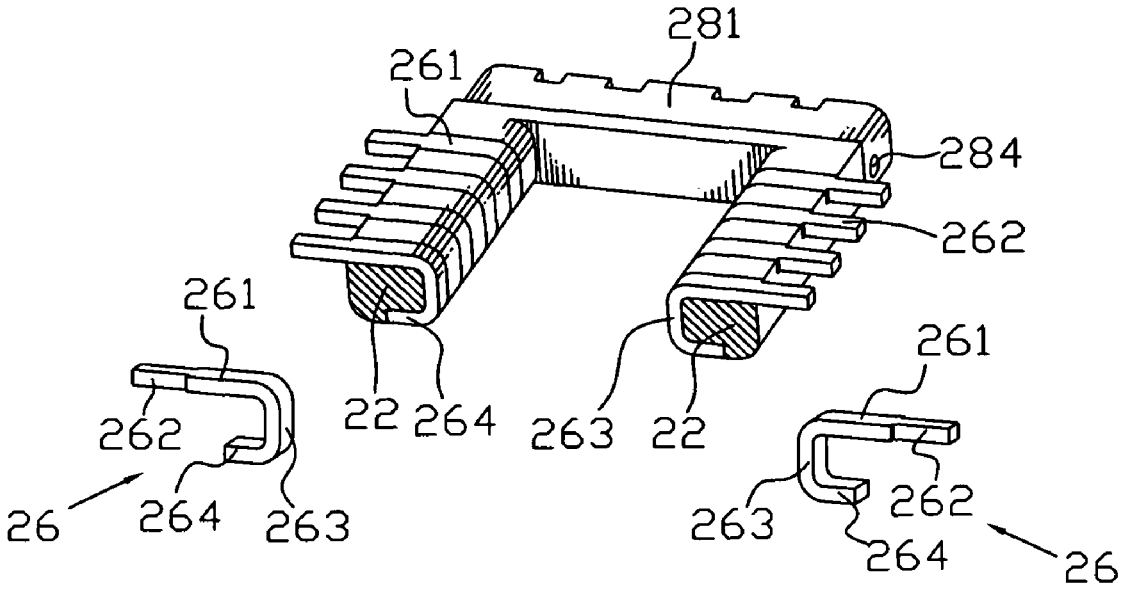
FIG. 6 is a sectional view of the plug connector of the board-to-board connector assembly of FIG. 1, with two second terminals being exposed therefrom.

Referring to FIG. 6, each of the second terminals 26 has a contact arm 263 disposed vertically. A top end of the contact arm 263 is bent and extends toward one side to form an upper fastening arm 261, and a bottom end thereof is bent and extends toward the same side with the upper fastening arm 261 to form a lower fastening arm 264. A free end of the upper fastening arm 261 further extends to form a soldering tail 262.

Figure 7:
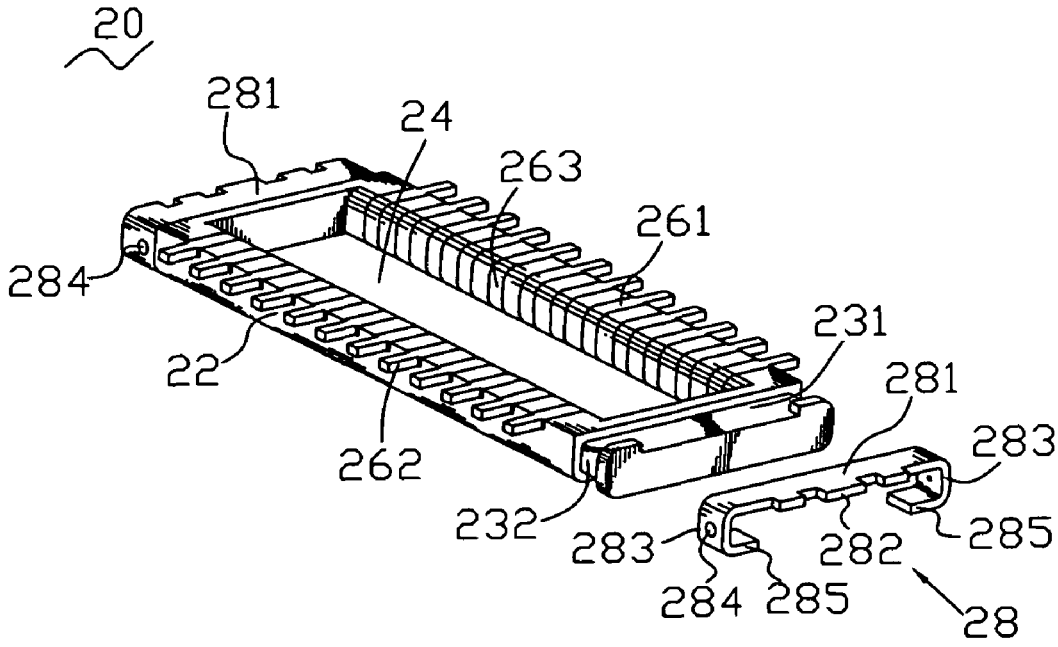
FIG. 7 is a partially exploded view of the plug connector of the board-to-board connector assembly of FIG. 1.

Referring to FIG. 7, each of the second fixing members 28 has a rectangular base plate 281 disposed levelly. A side edge of the base plate 281 protrudes sideward to form a plurality of fixing slices 282. Two ends of the base plate 281 extend downward to form a pair of connecting portions 283. Each of the connecting portions 283 defines a second fixing structure thereon. In the embodiment, the second fixing structure is a fixing projection 284 protruded outward from a middle of the corresponding connecting portion 283. Two bottom ends of the pair of connecting portions 283 extend face-to-face to form a pair of fastening portions 285 spaced from each other.

When the plug connector 20 is assembled, the second terminals 26 are mounted to the corresponding third sidewalls 22. The contact arm 263 of each of the second terminals 26 is inserted in the corresponding receiving passageway 221, the upper fastening arm 261 is fastened in the corresponding receiving trough 222 and the lower fastening arm 264 is fastened under the corresponding third sidewall 22. The soldering tail 262 stretches out of the corresponding third sidewall 22 for being soldered to a male printed circuit board (not shown). The second fixing members 28 are mounted to the corresponding fourth sidewalls 23. The base plate 281 of each of the second fixing members 28 is disposed in the corresponding receiving fillister 231 and the fixing slices 282 are buckled in the corresponding fixing grooves 233. The connecting portions 283 are inserted in the corresponding fastening fillisters 232 and the fastening portions 285 are fastened under the corresponding fourth sidewalls 23. So the second fixing members 28 can be firmly mounted on the corresponding fourth sidewalls 23.

Figure 8:
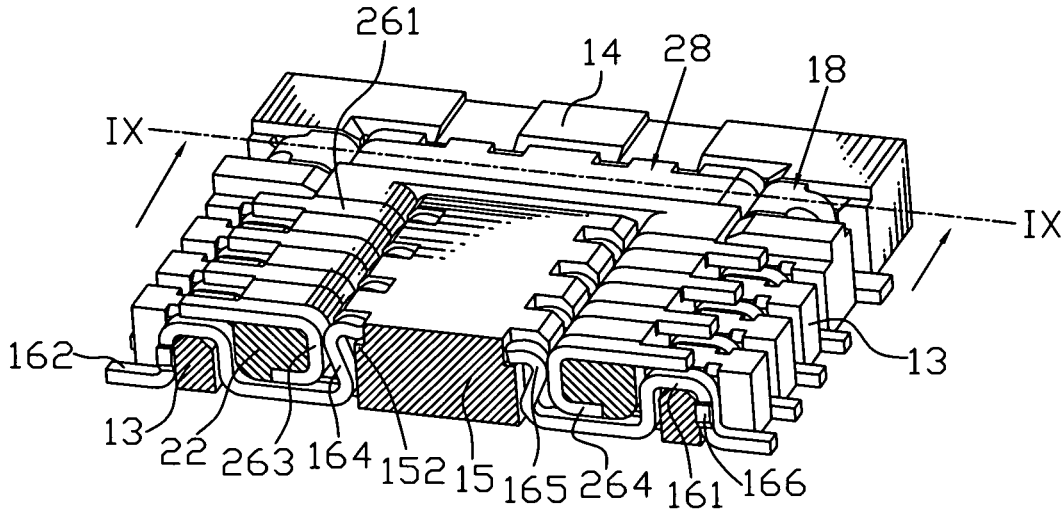
FIG. 8 is a sectional view of the board-to-board connector assembly of FIG. 1.
Figure 9:
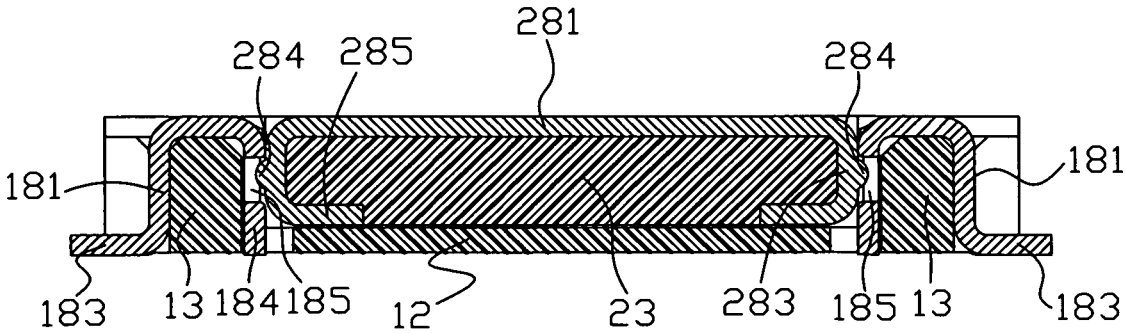
FIG. 9 is a cross-sectional view of the board-to-board connector assembly along line IX-IX of FIG. 8.
Figure 10:
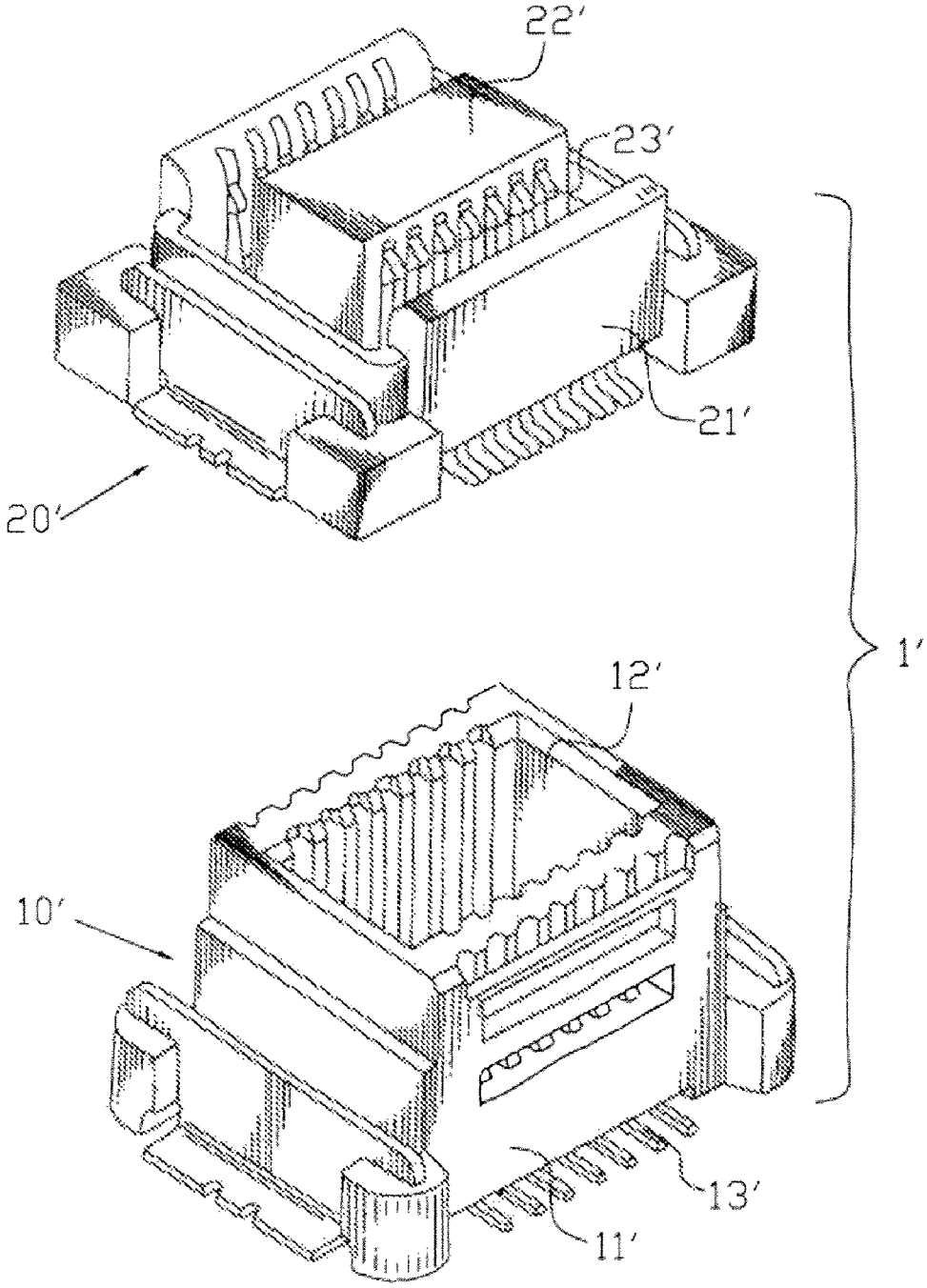
FIG. 10 PRIOR ART
FIG. 10 is a perspective view of a conventional board-to-board connector assembly.

Referring to FIG. 8 and FIG. 9, when the plug connector 20 is engaged with the receptacle connector 10, the third sidewalls 22 and the fourth sidewalls 23 of the plug connector 20 are inserted in the receiving recess 110 of the receptacle connector 10, and the inserting rib 15 is inserted in the receiving space 24. The contact portion 165 of the first terminal 16 is pressed by the contact arm 263 of the corresponding second terminal 26 to be received in the corresponding receiving channel 151, and a free end of the contact portion 165 is propped against the corresponding propping platform 152 such that the contact portion 165 can electrically abut against the corresponding contact arm 263 due to an elasticity of the corresponding elastic arm 164. When the plug connector 20 is completely engaged with the receptacle connector 10, the fixing projections 284 of the second fixing members 28 are buckled into the corresponding fixing holes 185 of the first fixing members 18 and the connecting portions 283 abut against the corresponding propping portions 184 such that can ensure the plug connector 20 and the receptacle connector 10 engaged with each other firmly and prevent the plug connector 20 from falling off from the receptacle connector 10 under being shaken.

As described above, the fixing holes 185 of the first fixing members 18 and the fixing projections 284 of the second fixing members 28 are defined to be buckled with each other so as to ensure that the receptacle connector 10 and the plug connector 20 are engaged with each other firmly. So an electrical connection between the first terminals 16 and the second terminals 26 can be steady even if the board-to-board connector assembly 1 is shaken.

What is claimed is:

1. A board-to-board connector assembly, comprising:

a receptacle connector having a receptacle housing defining a receiving recess at a top thereof and four sidewalls formed around the receiving recess, a plurality of first terminals disposed in the receptacle housing, and at least one first fixing member having a base portion disposed in the sidewall, a top of the base portion being bent toward one side and then extending downward to form a propping portion stretching into the receiving recess and defining a first fixing structure thereon; and a plug connector mated with the receptacle connector and having a plug housing received in the receiving recess of the receptacle housing, a plurality of second terminals disposed in the plug housing and electrically contacting the corresponding first terminals, and at least one second fixing member having a base plate disposed on the plug housing, at least one end of the base plate extending downward to form a connecting portion disposed on an outside surface of the plug housing and defining a second fixing structure thereon, wherein the second fixing structure is buckled with the first fixing structure and the connecting portion abuts against the propping portion when the plug connector is engaged with the receptacle connector.

2. The board-to-board connector assembly as claimed in claim 1, wherein the first fixing structure is a fixing hole passing through the propping portion and communicating with the receiving recess, the second fixing structure is a fixing projection protruded outward from a middle of the connecting portion, the fixing projection can be buckled into the fixing hole.

3. The board-to-board connector assembly as claimed in claim 1, wherein a bottom of the base portion extends toward the other side opposite to the propping portion to form a soldering portion stretching out of the corresponding sidewall.

4. The board-to-board connector assembly as claimed in claim 1, wherein a bottom end of the connecting portion extend toward the same side with the base board to form a fastening portion fastened under the plug housing.

5. The board-to-board connector assembly as claimed in claim 1, wherein an outside of the sidewall corresponding to the first fixing member defines at least one receiving cavity extending vertically, an inside of the sidewall defines at least one fastening channel extending vertically and communicating with the receiving recess, a top end of the receiving cavity is connected with a top end of the corresponding fastening channel, the base portion is received in the receiving cavity and the propping portion is inserted in the fastening channel.

6. The board-to-board connector assembly as claimed in claim 5, wherein the receiving cavity oppositely extends sideward to form a pair of fixing cavities, two side edges of the base portion protrude oppositely to form two fixing blocks buckled into the corresponding fixing cavities.

7. The board-to-board connector assembly as claimed in claim 1, wherein a top surface of the plug housing defines at least one receiving fillister and the outside surface thereof defines at least one fastening fillister extending vertically and connected with the receiving fillister, the base plate is received in the receiving fillister and the connecting portion is inserted in the fastening fillister.

8. The board-to-board connector assembly as claimed in claim 7, wherein the receiving fillister extends sideward to form a fixing groove, a side edge of the base plate protrudes sideward to form at least one fixing slice buckled in the fixing groove.

9. The board-to-board connector assembly as claimed in claim 1, wherein the sidewalls includes two first sidewalls at two opposite sides of the receiving recess, the first fixing members have four and are respectively mounted to two ends of each of the first sidewalls, the second fixing members have two and are respectively mounted to two ends of the plug housing for being buckled with the corresponding first fixing members, the connecting portions of each of the second fixing members have two and are formed by extending downward from two ends of the corresponding base board.

* * * * *